US010077172B1

(12) United States Patent
VanderLinden

(10) Patent No.: US 10,077,172 B1
(45) Date of Patent: Sep. 18, 2018

(54) INTERCHANGEABLE JIB TOOL

(71) Applicant: Altec Industries, Inc., Birmingham, AL (US)

(72) Inventor: Dorathea LoBean VanderLinden, Mesa, AZ (US)

(73) Assignee: Altec Industries, Inc., Birmingham, AL (US)

( * ) Notice: Subject to any disclaimer, the term of this patent is extended or adjusted under 35 U.S.C. 154(b) by 0 days.

(21) Appl. No.: 15/813,578

(22) Filed: Nov. 15, 2017

(51) Int. Cl.
*B66D 3/08* (2006.01)
*B66C 23/66* (2006.01)
*B66C 23/70* (2006.01)

(52) U.S. Cl.
CPC ..... *B66C 23/66* (2013.01); *B66C 23/701* (2013.01)

(58) Field of Classification Search
CPC ..... B66F 9/00; B66F 9/06; B66F 9/0655
See application file for complete search history.

(56) References Cited

U.S. PATENT DOCUMENTS 4,872,554 A * 10/1989 Quernemoen ..... C30B 31/10 118/500
6,065,620 A 5/2000 McGhie
6,202,282 B1 * 3/2001 Holdsworth ..... E04C 5/165 29/456
2010/0102551 A1 * 4/2010 Zeiber ..... F16L 33/23 285/253
2014/0172026 A1 * 6/2014 Biedermann ..... A61B 17/844 606/326
2015/0279710 A1 * 10/2015 Rebstock ..... H01L 21/67057 438/747

OTHER PUBLICATIONS

Hubbell Power Systems p. 19; Western Safety Products, Inc.; Date Printed: Feb. 22, 2018; Date Posted: Unknown; <http://www.westernsafety.com/products/hubbellpowersystems/hubbellpowerpg19.html>.
Hot Arms, Gins, Platforms & Ladders; Hi-Line Utility Supply Co.; Date Printed: Feb. 22, 2018; Date Posted: Unknown; <https://www.hilineco.com/api/downloads/51477903?filename=2014%20Hi-Line%20Catalog%20-%20p162-171%20-%20Hot%20Arms%20Gins%20Platforms%20&%20Ladders.pdf>.

* cited by examiner

*Primary Examiner* — Lee D Wilson
(74) *Attorney, Agent, or Firm* — Erise IP, P.A.

(57) ABSTRACT

A jib tool is configured to be secured to a distal end of a jib. The jib tool includes a wire-handler segment and a sheave segment. The wire-handler segment is configured to receive a wire. The sheave segment including a housing and a sheave. The sheave is configured to receive a load line. The sheave segment is configured to be placed in an operating position and a removal position, wherein the sheave is in a first location relative to the housing while the sheave segment is in the operating position, and wherein the sheave is in a second location relative to the housing while the sheave segment is in the removal position. The removal position is configured to allow a utility worker to remove the load line.

20 Claims, 6 Drawing Sheets

INTERCHANGEABLE JIB TOOL

BACKGROUND

1. Field

Embodiments of the invention relate to jib assemblies, being the projecting arm of a utility vehicle or the like.

2. Related Art

A jib assembly broadly comprises a jib arm extending from a support base. The jib assembly bears a load or an item of equipment. The jib arm may be telescoping to extend or retract into itself or into the base. The jib arm may rotate around the base in either or both of vertical and horizontal positions. The base itself may be movable relative to a larger item of equipment, such as a crane or a boom of an aerial device. The combination of these movements allows the jib arm to move the load or item of equipment into a desired location or orientation.

Jibs are used for many different applications. As such, it is common for a utility worker to begin a task using the jib for a first purpose and then switch to using the jib for a second purpose. Currently, switching jibs between purposes requires tools and complex procedures. As the jib and the utility worker are typically elevated during this procedure, the switching is time consuming and difficult. What is lacking in the prior art is a multi-purpose jib tool that is quick and easy to switch between tasks.

SUMMARY

Embodiments of the invention solve the above-mentioned problems by providing an interchangeable jib tool that includes both a sheave segment and a wire-handling segment. The interchangeable jib tool is configured to allow the utility worker to quickly, efficiently, and safely change between (for example) a load-lifting task and a wire-handling task.

A first embodiment of the invention is generally directed to a jib tool configured to be secured to a distal end of a jib, the jib tool comprising a wire-handler segment and a sheave segment. The wire-handler segment is configured to receive a wire. The wire-handler segment is configured to be placed in an open position and a closed position. The sheave segment including a housing and a sheave. The sheave is configured to receive a load line. The sheave segment is configured to be placed in an operating position and a removal position, wherein the sheave is in a first location relative to the housing while the sheave segment is in the operating position, and wherein the sheave is in a second location relative to the housing while the sheave segment is in the removal position. The removal position is configured to allow a utility worker to remove the load line.

A second embodiment of the invention is generally directed to a jib tool configured to be secured to a distal end of a jib, the jib tool comprising a wire-handler segment and a sheave segment. The wire-handler segment configured to receive a wire and be placed in an open position and a closed position. The sheave segment includes a sheave and a housing. The housing presents a track therein. The sheave disposed at least partially within the track, and is configured to receive a load line. The sheave segment is configured to be placed in an operating position and a removal position, wherein the sheave is in a first location along the track relative to the housing while the sheave segment is in the operating position, and wherein the sheave is in a second location along the track relative to the housing while the sheave segment is in the removal position. The removal position is configured to allow a utility worker to remove the load line.

A third embodiment of the invention is generally directed to a jib tool configured to be secured to a distal end of a jib, the jib tool comprising a sheave segment and a pin configured to receive a distal implement therein. The pin is configured to secure the distal implement coaxially with the housing of the sheave segment. The sheave segment includes a housing presenting a track, and a sheave disposed at least partially within the track. The sheave is configured to receive a load line. The sheave segment is configured to be placed in an operating position and a removal position, wherein the sheave is in a first location along the track relative to the housing while the sheave segment is in the operating position, and wherein the sheave is in a second location along the track relative to the housing while the sheave segment is in the removal position. The removal position is configured to allow a utility worker to remove the load line.

Additional embodiments of the invention may be generally directed to a method of installing and/or using the jib tool described herein. Still further embodiments of the invention may be directed to a jib assembly comprising a jib arm and the jib tool described herein. Yet further embodiments of the invention may be directed to a utility platform assembly comprising a utility platform and a jib assembly, which include the jib tool described herein. Yet still further embodiments of the invention may be directed to an aerial device comprising a base, a boom assembly, and a utility platform assembly having a jib assembly with the jib tool described herein.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

BRIEF DESCRIPTION OF THE DRAWINGS

Embodiments of the invention are described in detail below with reference to the attached drawing figures, wherein.

Figure 1:
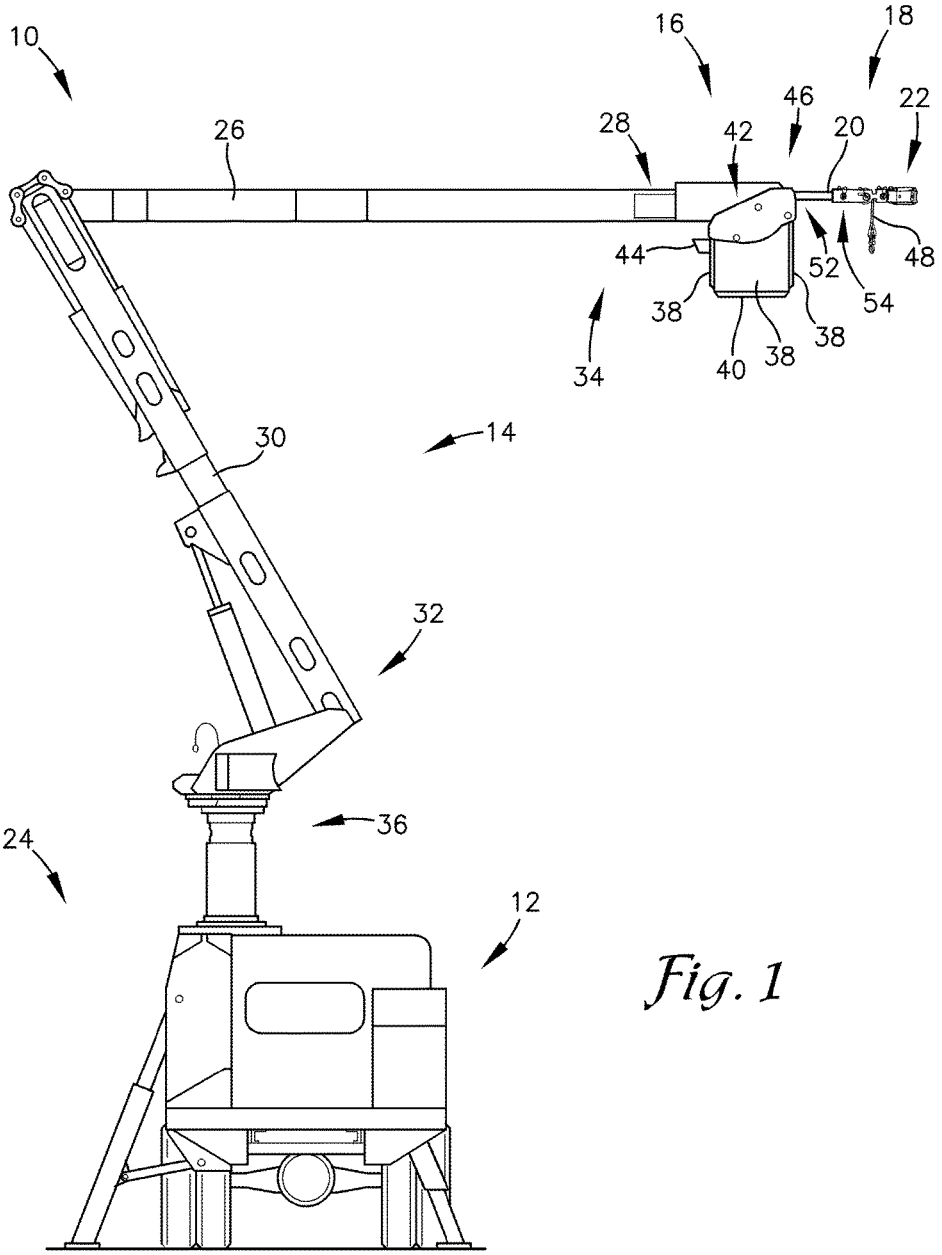
FIG. 1 is an environmental view of an exemplary jib assembly mounted on a boom of an aerial device.

The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention may be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etcetera described in one embodiment may also be included in other embodiments, but is not necessarily included. Thus, the present technology can include a variety of combinations and/or integrations of the embodiments described herein.

Figure 2:
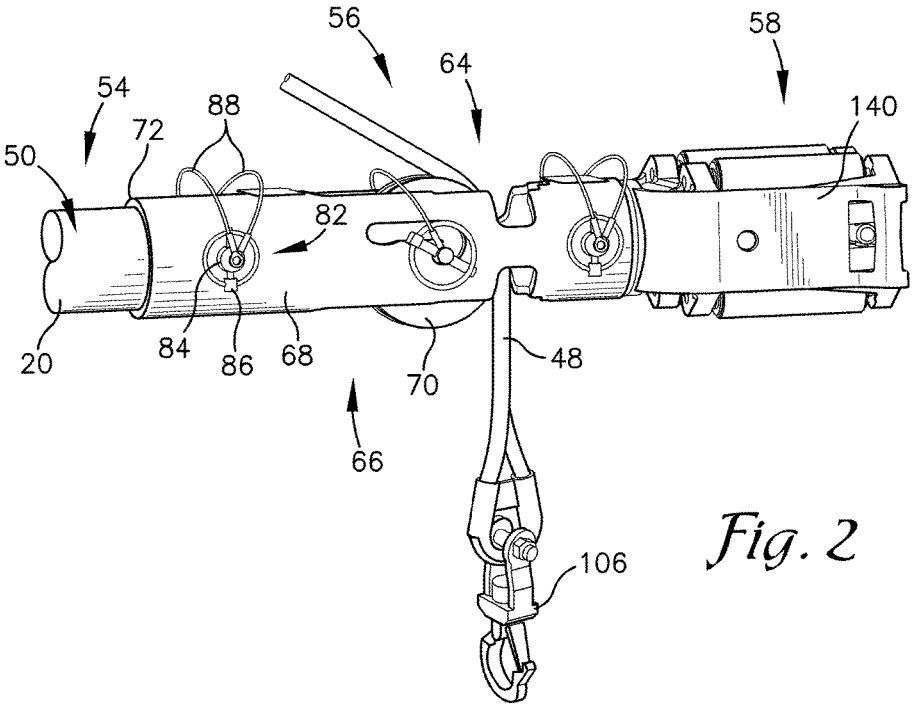
FIG. 2 is a perspective view of a jib tool disposed at a distal end of the jib assembly, shown with a sheave in an operating position with a load line and hook therethrough.

An aerial device 10, constructed in accordance with various embodiments of the invention, is shown in FIG. 1. The aerial device 10 generally comprises a base 12 with a boom assembly 14 rotatably mounted thereto. A utility platform assembly 16 is disposed on the boom assembly 14 to provide an aerial platform for the accomplishment of a task by a utility worker. A jib assembly 18 comprises a jib arm 20 and a jib tool 22. The jib tool 22 is configured to allow the utility worker to perform a plurality of tasks (as illustrated in FIG. 2 and discussed below). Before discussing the components and operation of the jib tool 22, the other components of the aerial device 10 will be discussed as an exemplary field of use for some embodiments of the invention. It should also be appreciated that embodiments of the invention may be utilized with other implements and tools associated with the boom assembly 14.

The base 12 of the aerial device 10 is a selectively stabilized platform. In embodiments of the invention, the base 12 is a utility truck 24 (as illustrated in FIG. 1), a crane base 12, an oilrig, an earth-working machine, or a fixed structure. The base 12 provides stability and a counterweight to a load being supported by the boom assembly 14. The base 12 also provides a hydraulic power system, pneumatic power system, electrical power system, or other system (not illustrated) that powers the movement of the utility platform assembly 16.

As illustrated in FIG. 1, the boom assembly 14 broadly comprises an outer boom section 26 and at least one inner boom section 28. As illustrated in FIG. 1, some embodiments of the boom assembly 14 may further comprise at least one pivoting boom section 30. The boom assembly 14 presents a proximal end 32 and a distal end 34. The proximal end 32 is rotatably and/or pivotably secured to a boom turret 36 of the base 12. The distal end 34 is secured to the utility platform assembly 16 and/or the jib assembly 18. The at least one inner boom section 28 is at least in part disposed within the outer boom section 26. The at least one inner boom section 28 telescopes to extend or retract into the outer boom section 26. The pivoting boom section 30 does not telescope out of any other boom section. Instead the pivoting boom section 30 rotates about the base 12, and the outer boom section 26 pivots and/or rotates relative to the pivoting boom section 30. The use of the pivoting boom section 30 allows the utility platform assembly 16 to reach certain areas and avoid obstacles in the working environment.

The utility platform assembly 16 provides an elevated surface from which at least one utility worker can perform a task. As illustrated in FIG. 1, embodiments of the utility platform assembly 16 comprise a plurality of bucket sidewalls 38 and a bucket floor 40 that collectively form a cavity 42. The utility platform assembly 16 may further comprise a step 44 and/or a door (not illustrated) in at least one of the bucket sidewalls 38 to allow for ingress and egress of the utility worker. The bucket sidewalls 38 may be unitary, i.e. formed of a single monolithic structure, or they may be coupled together. The transition between successive bucket sidewalls 38, and/or between the bucket sidewalls 38 and the bucket floor 40, may be rounded or arcuate.

In some embodiments, the utility platform assembly 16 presents a horizontal cross-section that is substantially rectangular. Thus, two of the opposing bucket sidewalls 38 may have a greater width than the other two opposing bucket sidewalls 38. In other embodiments, the utility platform assembly 16 presents a horizontal cross-section that is substantially square. Other embodiments of the utility platform assembly 16 may be other shapes about the horizontal cross-section, such as an ellipse, a circle, a D-shape, a triangle, a trapezoid, a rhombus, or other quadrilateral.

In embodiments of the invention, the utility platform assembly 16 further comprises a set of upper boom controls 46. The set of upper boom controls 46 are configured to be manipulated by the utility worker standing in the utility platform assembly 16 so as to move the utility platform assembly 16, the jib assembly 18, and/or the boom assembly 14 to a desired location and configuration. In embodiments, the set of upper boom controls 46 utilize hydraulic power that is supplied in the form of a hydraulic fluid by a set of hydraulic lines (not illustrated).

In embodiments of the invention, the boom assembly 14 and/or the utility platform assembly 16 further comprises the jib assembly 18. The jib assembly 18 is disposed on the distal end 34 of the boom assembly 14. The jib assembly 18 is configured to lift objects, handle wires, and may perform other tasks as desired by the utility worker. The jib assembly 18 has a jib arm 20 that is pivotably and/or telescopically secured to the boom assembly 14 and/or the utility platform assembly 16. A load line 48 extends from a winch (not illustrated) associated with the jib arm 20 to be lowered so as to be secured to a load or perform other tasks.

The jib tool 22 is coupled to the jib arm 20 and, in embodiments, surrounds the jib arm 20. The jib arm 20 is an elongated member, shaft, boom, rod, or pole that has a length and presents an outer surface 50, a proximal end 52, and a distal end 54. The jib arm 20 may be formed of a composite material, steel, aluminum, titanium, or PVC. The jib arm 20 may be solid or hollow. The jib arm 20 is configured to be utilized as a tool by the utility worker disposed in the utility platform assembly 16.

Figure 7:
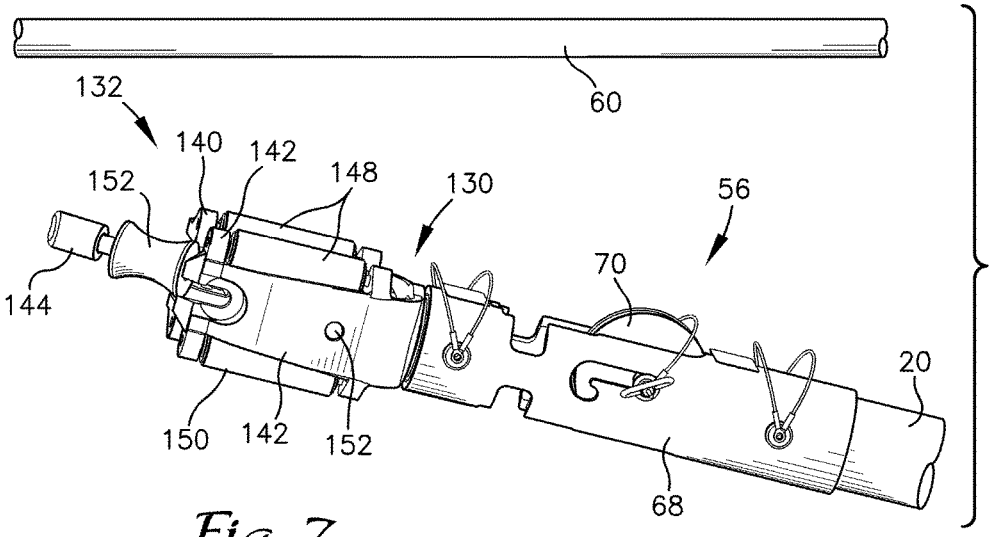
FIG. 7 is a detail view of the jib tool, with a wire-handler segment shown in an open position.
Figure 8:
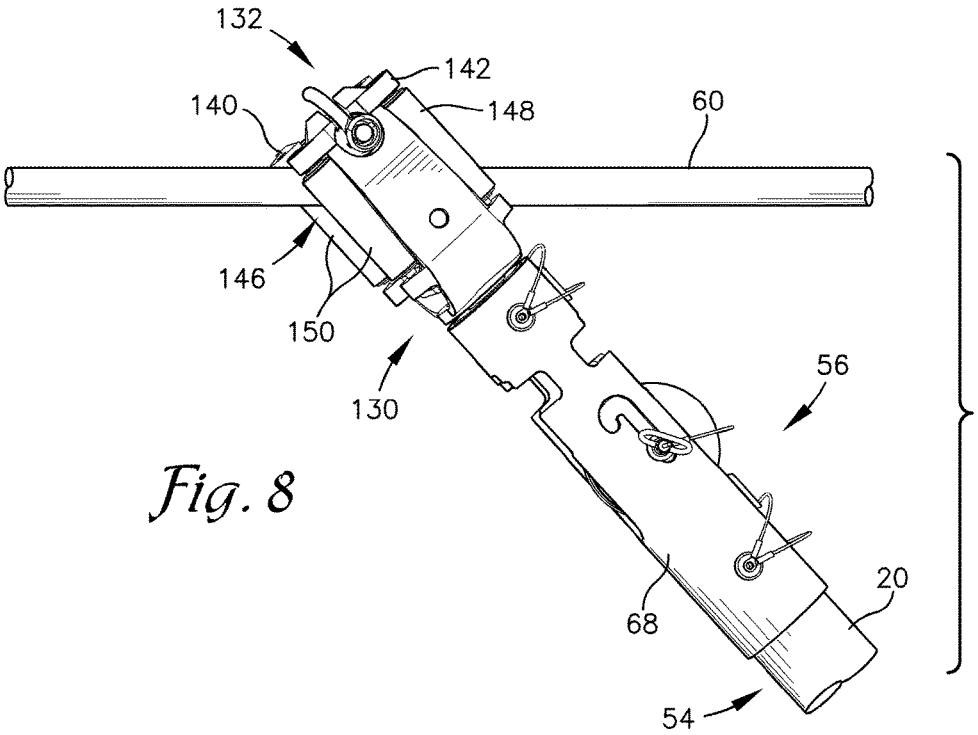
FIG. 8 is a detail view of the jib tool of FIG. 7, shown with the wire-handler segment in a close position with a wire therein.

Numerous tasks can be performed from the jib arm 20 by the use of the jib tool 22. In embodiments, the jib tool 22 includes a sheave segment 56 (also known as a pulley), as illustrated in the figures, from which the jib arm 20 can support a load (not illustrated). In embodiments, the jib tool 22 includes a wire-handler segment 58, as illustrated in the figures, from which the jib arm 20 distal end 54 can support a wire 60 (such as a power line, as illustrated in FIGS. 7 and 8). In alternative embodiments, the jib tool 22 may additionally or alternatively include a hook, a secondary jib, a winch, a pole guide, a drill bit, a cable, a video camera, a microphone, or a photography camera (not illustrated). The jib tool 22 at the jib arm 20 distal end 54 could also include a platform for supporting the utility worker or other person, such as a utility worker or videographer. The jib arm 20 distal end 54 could also support a load by other structures. The supported tool need not be at the jib arm 20 distal end 54, but could instead be anywhere along the length of the jib arm 20 as desired by the utility worker. For example, the sheave segment 56 discussed below could be disposed at an intermediate location along the jib arm 20. As used herein, the term "load" can mean an object to be moved or rotated, an object to be lifted, an object to be installed, or an item of equipment, such as those listed above.

Figure 3:
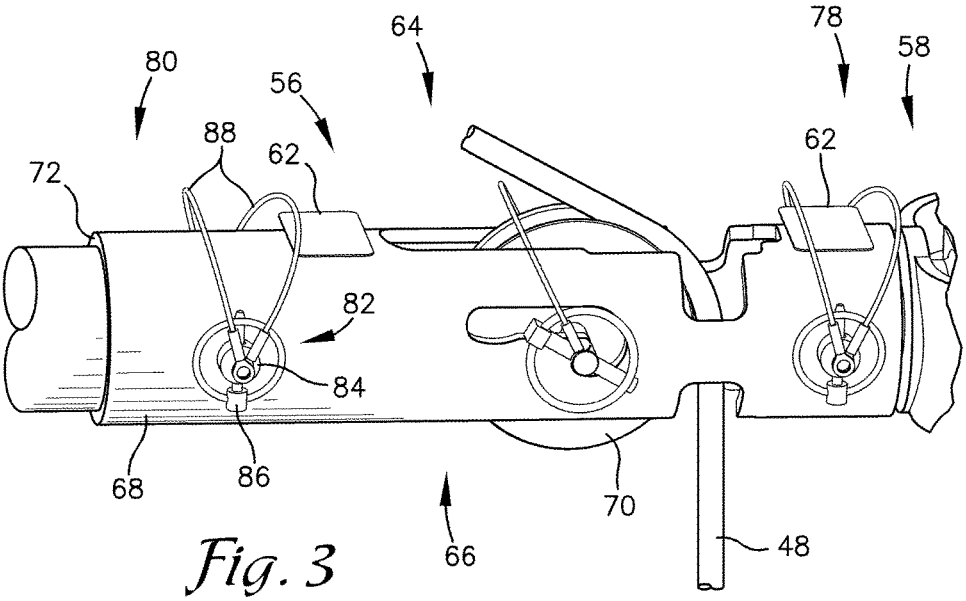
FIG. 3 is a detail view of a sheave segment of the jib tool illustrated in FIG. 2.

In one embodiment, the jib arm 20 has markings (not illustrated) along at least a portion of the jib arm 20 length. In one embodiment, these markings indicate the distance the jib arm 20 distal end 54 is extended beyond a starting position. The markings may represent actual relative lengths (in units of measures such as inches or meters) and be spaced accordingly. Alternatively or in addition, the markings may represent various predetermined positions, such as "stored," "general use," and "maximum extension." Markings may additionally or alternatively be shown on a label plate 62 disposed on the sheave segment 56 (as best illustrated in FIG. 3). These markings may represent a maximum weight of a load that can be safely lifted by sheave segment 56, the maximum weight of the load that can safely be lifted by the jib arm 20, provide other maximum operating parameters, and/or provide other safety information.

In embodiments of the invention, the jib tool 22 is configured to allow a utility worker to quickly and easily change between a first task and a second task. This change may be performed without tools or the disassembly of the jib tool 22 (such as for exchange of another jib tool 22, such as discussed above). Such a jib tool 22 may be described as a "quick-change" jib tool 22. In still another embodiment of the invention, the jib tool 22 is adapted to disassemble in such a way that it can be added to and removed from a jib assembly 18 or stationary member as needed.

Turning to FIG. 2, the structure of the jib tool 22 will now be discussed in more detail. The jib tool 22 is configured to be secured to the distal end 54 of the jib arm 20. In embodiments of the invention, the jib tool 22 comprises the wire-handler segment 58 and the sheave segment 56. The wire-handler segment 58 is configured to support a wire 60 therein (such as a power line or communications line). The wire-handler segment 58 may also be referred to as a "phase lifter." A phase lifter is used to lift a power line, communication line, or other wire 60 into a position such that it can be secured to a utility pole or other structure. The sheave segment 56 is configured to receive and direct the load line 48. The sheave segment 56 is configured to receive the load line 48 along a top side 64 and redirect the load line 48 through at least a portion of the sheave segment 56 to a bottom side 66.

In embodiments of the invention, the sheave segment 56 includes a housing 68 and a sheave 70. The sheave 70 is disposed at least partially within the housing 68. At least a portion of the sheave 70 extends beyond the top side 64 of the housing 68. This allows the sheave 70 to interact with the load line 48 running parallel, substantially parallel, or at an acute angle relative to a radial axis of the housing 68.

Figure 9:
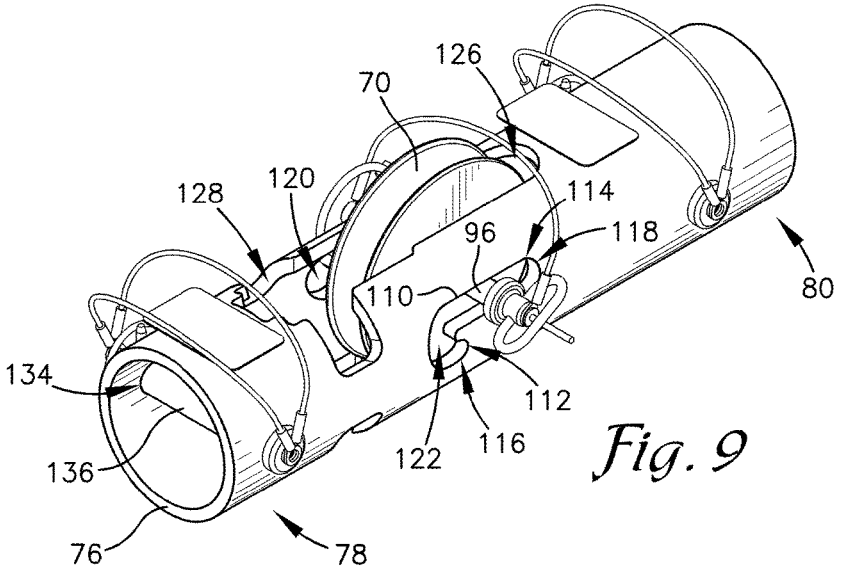
FIG. 9 is a detail view of the sheave segment, shown from an upper side.
Figure 10:
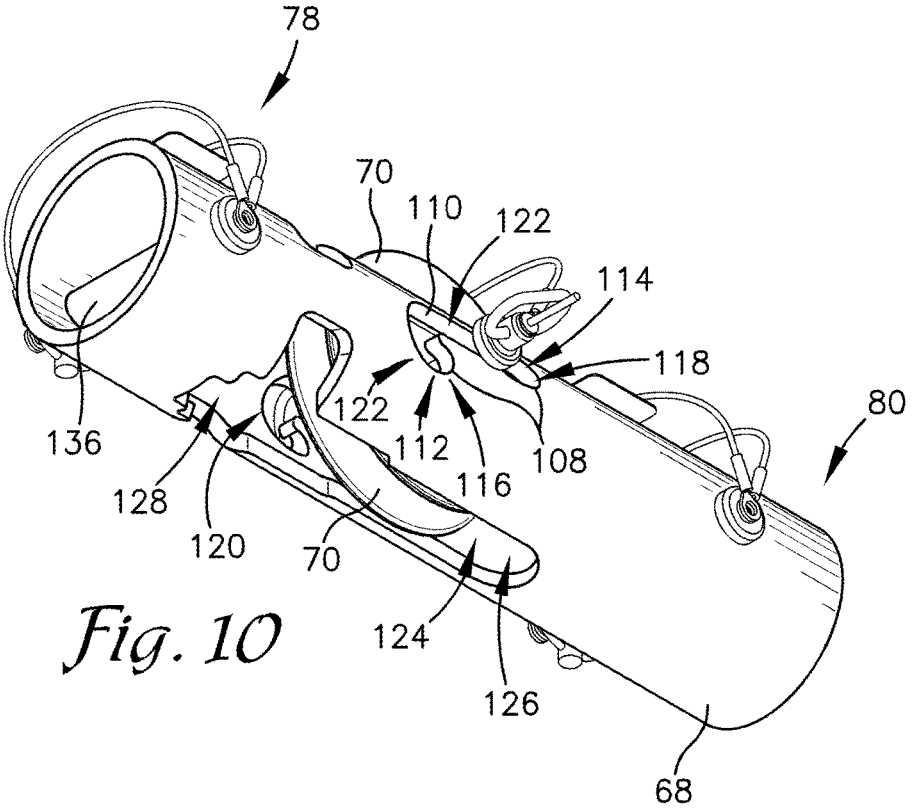
FIG. 10 is a detail view of the sheave segment of FIG. 9, shown from a lower side.

In embodiments of the invention, as best illustrated in FIGS. 9 and 10, the housing 68 is substantially cylindrical, so as to interface with a cylindrical jib arm 20. The cylindrical shape may be an open-ended cylinder (as illustrated), a closed-ended cylinder, or a single-closed-end cylinder. The housing 68 may include an outer wall 72 and at least one opening 74 therein. The outer wall 72 presents a thickness 76 (as best illustrated in FIG. 9) that is traversed by the at least one opening 74. The housing 68 presents a distal end 78 and a proximal end 80. The distal end 78 is secured to (or configured to be secured to) the wire-handler segment 58 or other distal implement. The proximal end 80 is secured to (or configured to be secured to) the jib arm 20.

The housing 68 may be permanently attached to the jib, or may be selectively secured to the jib such that it may be removed by the utility worker so as to allow another jib tool or device to be emplaced on the jib (such as to perform another task). For example, the housing 68 may include a pin opening 82 therein for receipt of a pin 84. The pin 84 secures the housing 68 to a distal end 54 of the jib arm 20. The pin 84 may include a retaining clip 86 to keep the pin 84 in the pin opening 82. The retaining clip 86 may include a strap 88 between a left side 90 and a right side 92 of the housing 68, so as to secure the pin 84 therebetween and/or to secure the pin to the housing 68. The strap 88 keeps the retailing clip secured to the pin 84. The strap 88 and the retaining clip 86 may also be selectively removed by the utility worker so as to uninstall the jib tool 22 from the jib arm 20 (such as to allow the utility worker to emplace another implement on the jib arm 20).

Figure 11:
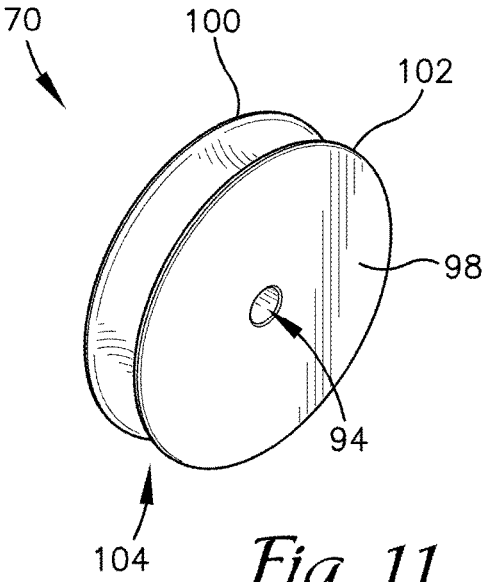
FIG. 11 is a detail view of the sheave of the sheave segment.

The sheave 70, as best illustrated in FIG. 11, is configured to act as a roller or wheel to receive and redirect the load line 48. The sheave 70 includes a rotation opening 94 configured to receive rotation pin 96 (best illustrated in FIGS. 9 and 10), a wheel body 98, a first annular protrusion 100, and a second annular protrusion 102. The rotation pin 96 is disposed at or near the geometric center of the wheel body 98, such that the wheel body 98 can spin or rotate therearound. The wheel body 98 presents a substantially flattened annular shape. The first annular protrusion 100 and the second annular protrusion 102 each extend laterally from the wheel body 98. The first annular protrusion 100 and the second annular protrusion 102 are separated by a distance so as to form a channel 104 therebetween. The channel 104 between the first annular protrusion 100 and the second annular protrusion 102 is configured to receive at least a portion of the load line 48 therein.

The sheave segment 56 is configured to be placed in an operating position (as illustrated in FIGS. 2 and 3) and a removal position (as illustrated in FIGS. 4-8). In the operating position, the sheave segment 56 is configured to be operated by the utility worker and a winch to raise and lower the load line 48 as desired (such as to raise a load). In the operating position, the load line 48 is secured such that the load line 48 (and more specifically, a hook 106 of the load line 48) cannot be removed from the housing 68. In the removal position, the sheave segment 56 is configured to allow the load line 48 (and more specifically the hook 106 of the load line 48) to be removed from the housing 68.

In embodiments of the invention, the sheave 70 is configured to move relative to the housing 68. The sheave 70 may slide, roll, or otherwise laterally displace between locations. The sheave 70 may be held in the locations by the sheave 70 resting against a rest stop 108 (best illustrated in FIG. 10) of the outer wall 72 (or other component) or may be locked into the position. The sheave 70 is in a first location relative to the housing 68 while the sheave segment 56 is in the operating position. As discussed above, the operating position is configured to prevent removal of the load line 48. The sheave 70 is in a second location relative to the housing 68 while the sheave segment 56 is in the removal position. The removal position is configured to allow a utility worker to remove the load line 48. The load line 48 may be removed such that the utility worker can utilize the wire-handler segment 58, perform other tasks, or may uninstall the jib tool 22.

In embodiments of the invention, the sheave segment 56 further comprises a track 110 having the sheave 70 disposed therein. The track 110, being one of the aforementioned openings 74 in the housing 68, allows the rotation pin 96 to traverse the opening 74. The rotation pin 96 therefore is configured to slide along the track 110. The sheave 70 is therefore configured to slide along the track 110 between the first position and the second position. In some embodiments, the first position is at a first end 112 of the track 110 and the second position is at a second end 114 of the track 110. Placing the first position and the second position at the respective ends of the track 110 allows forces placed on the sheave 70 to keep the sheave 70 in the respective position, while allowing the sheave 70 to be manually moved between positions without the use of any external tools (which have a tendency to become lost in the utility platform assembly 16 and also slow down the usage of the jib tool 22).

Figure 6:
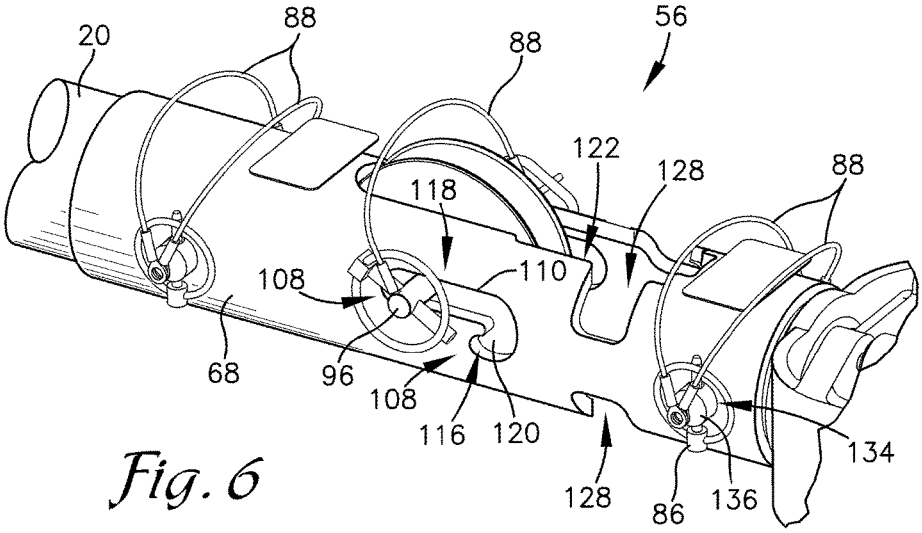
FIG. 6 is a detail view of the sheave segment of FIG. 6, shown with the load line removed.

In embodiments of the invention, the track 110 presents a general horizontal J-shape with a hooked end 116 of the J-shape including the first position and a straight end 118 of the J-shape including the second position. The track 110 may include a right-side track 120 (as illustrated in FIG. 6) and a left-side track 122 (as illustrated in FIG. 7). The right-side track 120 is diametrically opposed to the left-side track 122 such that the rotation pin 96 of the sheave 70 is disposed therebetween. The left-side track 122 and the right-side track 120 may be referred to collectively as a horizontal opening in the housing 68 (being one of the aforementioned at least one opening 74 in the housing 68). The left-side track 122 and the right-side track 120 may present a substantially similar shape and be symmetrical such that the rotation pin 96 remains substantially horizontal in the first position, the second position, and in intermediate positions between the first position and the second position.

In some embodiments, the horizontal J-shape is oriented such that the hooked end 116 is lower than and distally away from the straight end 118. (e.g., the J-shape is tipped forward from the typical orientation). The hooked end 116 and the straight end 118 are both disposed toward the proximal end 80 of the housing 68. In this way, the force exerted on the sheave 70 by the load line 48 will keep the sheave 70 in the first position and the second position, respectively, without any additional locks, while allowing the utility worker to overcome the force of the load line 48 to move the sheave 70 between the first position and the second position.

In embodiments of the invention, the sheave 70 is configured to freely slide between the first position and the second position without locking in either the first position or the second position. As such, the sheave 70 becomes pressed against the straight end 118 or the hooked end 116 of the J-shaped track by the forces exerted on the sheave 70 (such as by the load line 48). These forces may be overcome so as to move the sheave 70 between the operating position and the removal position.

In embodiments of the invention, the housing 68 of the sheave segment 56 includes a vertical opening 124 (being one of said at least one opening 74 in the housing 68) configured to allow the hook 106 of the load line 48 to vertically pass therethrough while the sheave 70 is in the removal position. The vertical opening 124 includes a sheave opening segment 126 and a hook-receptor opening segment 128. The sheave opening segment 126 allows a portion of the sheave 70 to be disposed above the top side 64 and/or below the bottom side 66 of the housing 68, so as to allow the load line 48 to interface with the sheave 70. The sheave opening segment 126 may be a channel or other oversized opening so as to allow the sheave 70 to rotate in both the first position and the second position. It should be appreciated that in embodiments of the invention, the sheave 70 is in a different location horizontally and/or vertically between the first position and the second position. As such, the sheave opening segment 126 accommodates the rotation of the sheave 70 in both the first position and the second position.

The hook-receptor opening segment 128 is disposed adjacent to the sheave opening segment 126. In some embodiments, the hook-receptor opening segment 128 is contiguous with the sheave opening segment 126 such that they form a single vertical opening 124 (including a top-side opening and a bottom-side opening). The hook-receptor opening segment 128 is configured to allow the hook 106 (and other components) of the load line 48 to pass through the housing 68 of the jib tool 22. The hook-receptor opening segment 128 may therefore present a shape that is complementary to and slightly larger than the hook 106. The hook-receptor opening segment 128 may alternatively present a shape that is large enough to accommodate the passing of the hook 106 therethrough.

In embodiments of the invention, the hook 106 is prevented from passing through the hook-receptor opening when the sheave 70 is in the operating position. This prevents an inadvertent removal of the load line 48 (such as by an over-tightening of the winch associated with the load line 48) and keeps the load line 48 secure. The hook 106 is prevented from passing through the hook-receptor opening segment 128 by the sheave 70 being disposed at least partially within the hook-receptor opening segment 128. This is because the second location (associated with the operating position) is disposed laterally toward the distal end 78 of the housing 68. As such, the hook 106 cannot pass through the hook-receptor opening segment 128 without striking the sheave 70, thus preventing removal.

The wire-handler segment 58 will now be discussed in more detail. The wire-handler segment 58 is disposed at the distal end 78 of the housing 68. The wire-handler segment 58 is coaxially aligned with the sheave segment 56. The wire-handler segment 58 therefore also includes a proximal end 130 (secured to the sheave segment 56) and a free distal end 132. Because the sheave segment 56 is coaxially aligned with the wire-handler segment 58, the wire-handler segment 58 may be used by the utility worker in the same way as if the sheave segment 56 were not present. The wire-handler segment 58 may also be used only when the hook 106 and the load line 48 have been removed from the sheave 70, so as to prevent a discharge of electricity through the load line 48 (either downward through the load line 48 and the load to the ground, or rearward through the winch).

It should also be appreciated that the wire-handler segment 58 is only one exemplary distal implement that can be disposed at the distal end 78 of the housing 68. Other embodiments may utilize other implements disposed at the distal end 78 of the housing 68. In some embodiments, the above-discussed sheave segment 56 is configured to receive any of a plurality of implements. In some of these embodiments, not illustrated, the distal end 78 of the housing 68 may present a similar shape to the distal end 54 of the jib arm 20 (so as to receive implements thereon). In other embodiments, the housing 68 of the sheave segment 56 may include a second pin opening 134 therein for receipt of a second pin 136. The second pin 136 secures the housing 68 to the implement. The second pin 136 may also include a retaining clip 86 and a strap 88 to keep the second pin 136 securely in place. In other embodiments, the sheave segment 56 is unitary (e.g., monolithic) with the wire-handler segment 58.

The wire-handler segment 58 is configured to receive a wire 60 therein. The wire-handler segment 58 allows the utility worker (with assistance of the jib arm 20) to lift, turn, or otherwise move the wire 60 into a certain position or orientation. The wire 60 may be a power line, a communication line, a guy wire, or other wire/cable. The wire-handler segment 58 allows the utility worker to utilize the force of the jib in extending, retracting, and/or pivoting (and/or the force of movement of the boom assembly 14) to move the wire 60 to the desired orientation or location.

In embodiments of the invention, the wire-handler segment 58 comprises a base 138, a first protrusion 140, a second protrusion 142, and a gate 144. The first protrusion 140 and the second protrusion 142 extend longitudinally from the base 138. The first protrusion 140 may be substantially parallel to the second protrusion 142. The gate 144 is associated with the second protrusion 142 for selectively closing a void 146 between the first protrusion 140 and the second protrusion 142. The gate 144 selectively locks against the first protrusion 140. The wire-handler segment 58 is configured to be placed in an open position (as illustrated in FIG. 7) and a closed position (as illustrated in FIG. 8). In the open position, the gate 144 is not secured against the first protrusion 140. In the closed position, the gate 144 is secured against the first protrusion 140.

In embodiments of the invention, the first protrusion 140 and the second protrusion 142 each present an upper roller 148 and a lower roller 150. The upper roller 148 and the lower roller 150 each facilitate movement of the wire 60 relative to the wire-handler segment 58. Typically, the upper roller 148 and the lower roller 150 are each free spinning so as to accommodate movement of the wire 60 in any direction and at any speed. In some embodiments, the gate 144 and/or the base 138 include a roller 152 to facilitate movement of the wire 60 relative to the wire-handler segment 58.

One embodiment of a method of using the jib tool 22 will now be discussed. An exemplary method is shown across FIGS. 2-8. In FIG. 2, the load line 48 is disposed across the sheave 70 and downward toward a load (not illustrated). In embodiments of the invention, the method may include the utility worker emplacing the hook 106 of the load line 48 downward through the hook-receptor opening segment 128 and around the sheave 70 (which the sheave 70 is in the removal position) and then moving the sheave 70 into the operating position.

Figure 4:
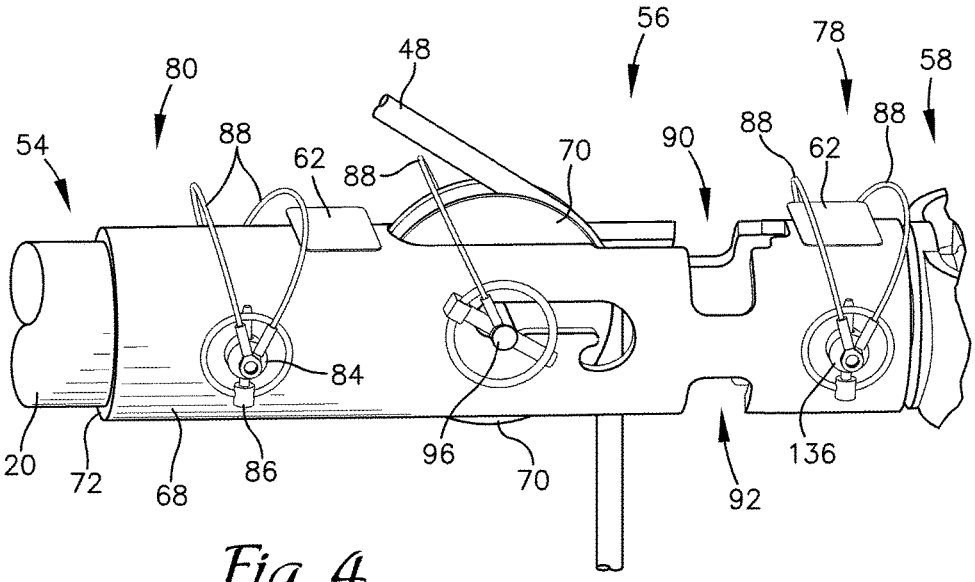
FIG. 4 is a detail view of the sheave segment of FIG. 3, shown in a removal position.
Figure 5:
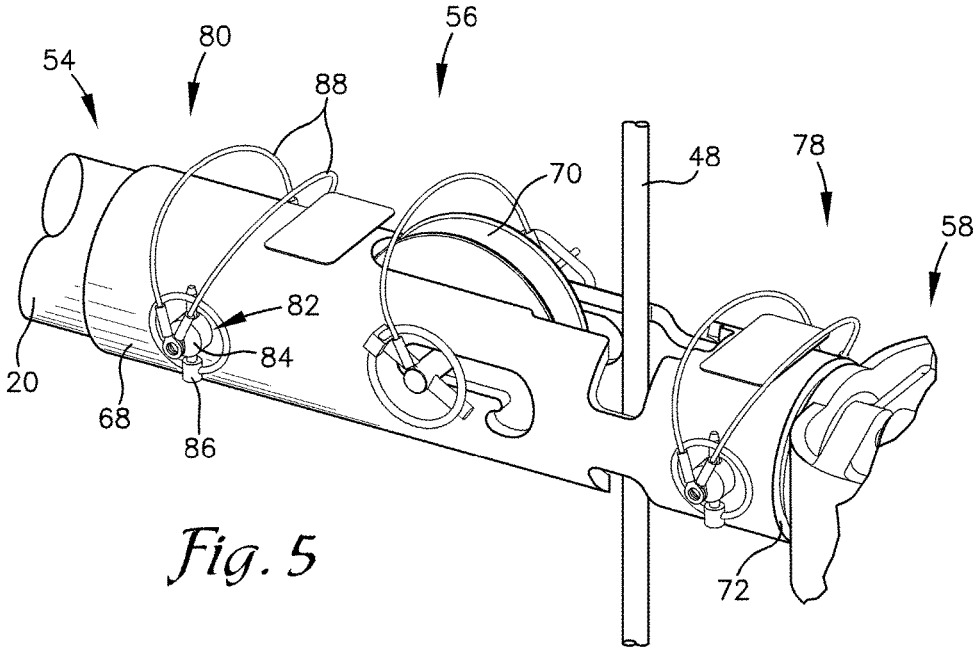
FIG. 5 is a detail view of the sheave segment of FIG. 4, shown with the load line being removed.

In FIG. 3, being shown from the right side 92 of the jib tool 22, the utility worker utilizes the load line 48 to lift a load while the sheave 70 is in the operating position. In FIG. 4, such as upon completion of the lifting task, the utility worker moves the sheave 70 from the operating position (as illustrated in FIG. 3) to the removal position. The load line 48 is still disposed around the sheave 70. In FIG. 5, the utility worker grasps the load line 48 and lifts vertically. Because the sheave 70 is in the removal position, the hook 106 of the load line 48 will pass directly through the hook-receptor opening segment 128 and away (so as to be stowed in another location, such as around the winch. In FIG. 6, the sheave segment 56 is shown without the load line 48 thereon, such as following removal of the load line 48 by the utility worker.

In FIG. 7, being shown from the left side 90 of the jib tool 22, the utility worker prepares to manipulate the wire 60 using the wire-handler segment 58. The utility worker moves the gate 144 to the open position, such that the wire 60 may be placed into the void 146. The utility worker then moves the jib arm 20 and/or the wire 60, such that the wire 60 is disposed within the void 146. In FIG. 8, the utility worker closes and locks the gate 144, such that the wire 60 is disposed therein. The utility worker may then make further movements to the jib arm 20 so as to manipulate the wire 60. The wire 60 may move along the rollers 148,150, 152 of the wire-handler segment 58 as the wire 60 is being manipulated. For example, the utility worker may use the jib arm 20 as a phase lifter to lift the wire 60 into position such that it may be secured to a utility pole or other structure. Upon completion of the lifting and/or manipulating task, the utility worker may then unlock the gate 144 so as to allow the utility worker to move the jib arm 20 and/or the wire 60 out of the void 146 within the wire-handler segment 58.

Although the invention has been described with reference to the exemplary embodiments illustrated in the attached drawings, it is noted that equivalents may be employed and substitutions made herein without departing from the scope of the invention as recited in the claims. Other methods may be used without departing from the scope of the invention.

Having thus described various embodiments of the invention, what is claimed as new and desired to be protected by Letters Patent includes the following:

1. A jib tool configured to be secured to a distal end of a jib, the jib tool comprising:

a wire-handler segment configured to receive a wire, wherein the wire-handler segment is configured to be placed in an open position and a closed position; and a sheave segment including— a housing, and a sheave configured to receive a load line, wherein the sheave segment is configured to be placed in an operating position and a removal position, wherein the sheave is in a first location relative to the housing while the sheave segment is in the operating position, wherein the sheave is in a second location relative to the housing while the sheave segment is in the removal position, wherein the sheave is configured to freely slide between the first location and the second location without locking in either the first location or the second location, wherein the removal position is configured to allow a utility worker to remove the load line.

2. The jib tool of claim 1, wherein the operating position is configured to prevent removal of the load line.

3. The jib tool of claim 1, wherein the sheave segment further comprises:

a track having the sheave disposed therein, wherein the sheave is configured to slide along the track between the first location and the second location.

4. The jib tool of claim 3, wherein the track presents a general horizontal J-shape with a hooked end of the J-shape including the first location and a straight end of the J-shape including the second location.

5. The jib tool of claim 3, wherein the sheave is configured with a rotating pin, wherein the rotating pin is configured to slide along the track.

6. The jib tool of claim 1, wherein the wire-handler segment is coaxially aligned with the sheave segment.

7. The jib tool of claim 6, wherein the wire-handler segment is configured to be utilized while the load line is absent from the sheave so as to prevent an electrical discharge through the load line.

8. The jib tool of claim 6, wherein the wire-handler segment comprises:

a first protrusion;

a second protrusion; and a gate associated with the second protrusion for selectively closing a void between the first protrusion and the second protrusion.

9. The jib tool of claim 1, wherein the housing of the sheave segment includes a hook-receptor opening configured to allow a hook of the load line to vertically pass therethrough while the sheave is in the removal position.

10. The jib tool of claim 9, wherein the hook is prevented from passing through the hook-receptor opening when the sheave is in the operating position.

11. A jib tool configured to be secured to a distal end of a jib, the jib tool comprising:

a wire-handler segment configured to receive a wire, wherein the wire-handler segment is configured to be placed in an open position and a closed position; and a sheave segment including— a housing presenting a track, and a sheave disposed at least partially within the track, said sheave configured to receive a load line, wherein the sheave segment is configured to be placed in an operating position and a removal position, wherein the sheave is in a first location along the track relative to the housing while the sheave segment is in the operating position, wherein the sheave is in a second location along the track relative to the housing while the sheave segment is in the removal position, wherein the sheave is configured with a rotating pin, wherein the rotating pin is configured to slide along the track, wherein the removal position is configured to allow a utility worker to remove the load line.

12. The jib tool of claim 11, wherein the operating position is configured to prevent removal of the load line.

13. The jib tool of claim 12, wherein the track presents a general horizontal J-shape with a hooked end of the J-shape including the first location and a straight end of the J-shape including the second location, wherein the hooked end is disposed distally and below the straight end of the J-shape.

14. The jib tool of claim 13, wherein the sheave is configured to freely slide between the first location and the second position without locking in either the first position or the second location.

15. The jib tool of claim 11, wherein the wire-handler segment comprises:

a first protrusion;

a second protrusion; and a gate associated with the second protrusion for selectively closing a void between the first protrusion and the second protrusion, wherein the wire-handler segment is coaxially aligned with the sheave segment.

16. The jib tool of claim 11, wherein the housing of the sheave segment includes a hook-receptor opening configured to allow a hook of the load line to vertically pass therethrough while the sheave is in the removal position, wherein the hook is prevented from passing through the hook-receptor opening when the sheave is in the operating position.

17. A jib tool configured to be secured to a distal end of a jib, the jib tool comprising:

a sheave segment including— a housing presenting a track, and a sheave disposed at least partially within the track, said sheave configured to receive a load line, wherein the track presents a general horizontal J-shape, wherein the sheave segment is configured to be placed in an operating position and a removal position, wherein the sheave is in a first location along the track relative to the housing while the sheave segment is in the operating position, wherein the sheave is in a second location along the track relative to the housing while the sheave segment is in the removal position, wherein the removal position is configured to allow a utility worker to remove the load line; and a pin configured to receive a distal implement therein, wherein the pin is configured to secure the distal implement coaxially with the housing of the sheave segment.

18. The jib tool of claim 17, wherein a hooked end of the J-shape includes the first location and a straight end of the J-shape includes the second location, wherein the hooked end is disposed distally and below the straight end of the J-shape.

19. The jib tool of claim 17, wherein the sheave is configured to freely slide between the first location and the second position without locking in either the first position or the second location.

20. The jib tool of claim 17, wherein the housing of the sheave segment includes a hook-receptor opening configured to allow a hook of the load line to vertically pass therethrough while the sheave is in the removal position, wherein the hook is prevented from passing through the hook-receptor opening when the sheave is in the operating position.

* * * * *